US006929479B2

(12) United States Patent
Bellows et al.

(10) Patent No.: US 6,929,479 B2
(45) Date of Patent: Aug. 16, 2005

(54) ATHLETE TRAINING DEVICE

(75) Inventors: Scott D. Bellows, Freehold, NJ (US); Thomas D. Kling, Manchester, NJ (US); Wayne J. Schultz, Forked River, NJ (US)

(73) Assignee: Eastern Automation Systems, Inc., Farmingdale, NJ (US)

( * ) Notice: Subject to any disclaimer, the term of this patent is extended or adjusted under 35 U.S.C. 154(b) by 27 days.

(21) Appl. No.: 10/698,027

(22) Filed: Oct. 31, 2003

(65) Prior Publication Data

US 2004/0132559 A1 Jul. 8, 2004

Related U.S. Application Data

(60) Provisional application No. 60/422,481, filed on Oct. 31, 2002.

(51) Int. Cl.[7] ..... G09B 19/00
(52) U.S. Cl. ..... 434/251; 473/441
(58) Field of Search ..... 434/247, 248, 434/251, 252, 258; 473/438, 441, 442, 445; 482/1, 3, 4, 8

(56) References Cited

U.S. PATENT DOCUMENTS 4,534,557 A * 8/1985 Bigelow et al. ..... 473/442
4,774,679 A * 9/1988 Carlin ..... 702/41
5,271,627 A * 12/1993 Russell et al. ..... 273/445
5,469,740 A * 11/1995 French et al. ..... 73/379.04
5,474,290 A * 12/1995 Rascona et al. ..... 473/441
5,605,336 A * 2/1997 Gaoiran et al. ..... 273/445
5,755,576 A * 5/1998 Dunn et al. ..... 434/258
5,897,457 A * 4/1999 Mackovjak ..... 482/8
6,002,336 A * 12/1999 Widding et al. ..... 340/573.1
6,093,119 A * 7/2000 Tipton ..... 473/438
6,110,079 A * 8/2000 Luedke et al. ..... 482/83
6,575,879 B1 * 6/2003 Harney et al. ..... 482/54

* cited by examiner

*Primary Examiner*—Kurt Fernstrom
(74) *Attorney, Agent, or Firm*—Harbin, King & Klima

(57) ABSTRACT

An athlete training device includes a first sensor pad for signaling when a first object has been removed from the first pad and a second sensor pad for signaling when an athlete's hand has been removed from the second pad. A third sensor signals when the athlete has made contact with a second object. A control device receives the signals from the pads and third sensor and determines a first elapsed time from when the first object is removed from the first pad and the athlete's hand is removed from the second pad. The control device also determines a second elapsed time from when the athlete's hand is removed from the second pad and the athlete makes contact with the second object and then outputs a signal for displaying the first and second elapsed times.

20 Claims, 5 Drawing Sheets

ATHLETE TRAINING DEVICE

This Application claims priority to U.S. Provisional Patent Application No. 60/422,481, to Bellows et al., entitled Lineman Trainer and filed Oct. 31, 2002, which application is incorporated by reference herein.

BACKGROUND OF THE INVENTION

Offensive/defensive linemen in football rarely benefit from accurate assessment of their effectiveness. It is difficult to measure the skills necessary to play these key positions. Amongst other skills, a lineman's speed of reaction is extremely important. The quicker the lineman can react, especially to the snap of the football, the greater the advantage for that lineman to accomplish his assigned task for that play. In addition to the reaction time, the lineman's speed in moving from the stationary position to contact with an opposing player, often referred to as the player's explosiveness, is also extremely important. Reaction time and explosiveness are not necessarily related and it cannot be assumed that a player with a quick reaction is also extremely explosive, or vice versa. Therefore, it is useful to be able to measure both of these aspects independently of one another.

Currently, use of a stopwatch is the primary method for measuring a lineman's reaction times. This method is inaccurate due to the manual operation of the stopwatch by the coach/observer and requires a coach to divert attention from the athlete to the stopwatch. Thus, while the coach is concentrating on taking an accurate measurement with the stopwatch, he is lass able to concentrate on the technique of the athlete. Use of the stopwatch can then become as much a test of the coach's coordination as it is of the athlete's.

It is an object of the invention to provide an apparatus by which the reaction time of an athlete can be accurately determined.

It is a further object of the invention to provide an apparatus by which the explosiveness of an athlete can be accurately determined.

It is a further object of the invention to provide an automatic mechanism by which an athlete's reaction time can be accurately determined.

It is a further object of the invention to provide an automatic mechanism by which an athlete's explosiveness can be accurately determined.

It is a further object of the invention to provide an apparatus by which the force of an athlete contacting an object can be accurately determined.

It is a further object of the invention to provide an automatic mechanism by which the force of an athlete contacting an object can be accurately determined.

SUMMARY OF THE INVENTION

An athlete training device includes a first sensor pad for signaling when a first object has been removed from the first pad, such as by the snap of a football resting on the first pad. A second sensor pad signals when an athlete's hand has been removed from the second pad. A third sensor signals when the athlete has made contact with a second object, such as a tackling dummy. A control device receives the signals from the pads and third sensor and determines a first elapsed time from when the first object is removed from the first pad and the athlete's hand is removed from the second pad. The control device also determines a second elapsed time from when the athlete's hand is removed from the second pad and the athlete makes contact with the second object. The control device outputs a signal for displaying the first elapsed time as a snap reaction time and the second elapsed time as an explosiveness time.

In a further embodiment, an accelerometer can be used to also measure and display the force by which the athlete contacts the blocking dummy.

Other aspects and objects of the invention can be realized from the description below.

DETAILED DESCRIPTION OF THE INVENTION

Figure 1:
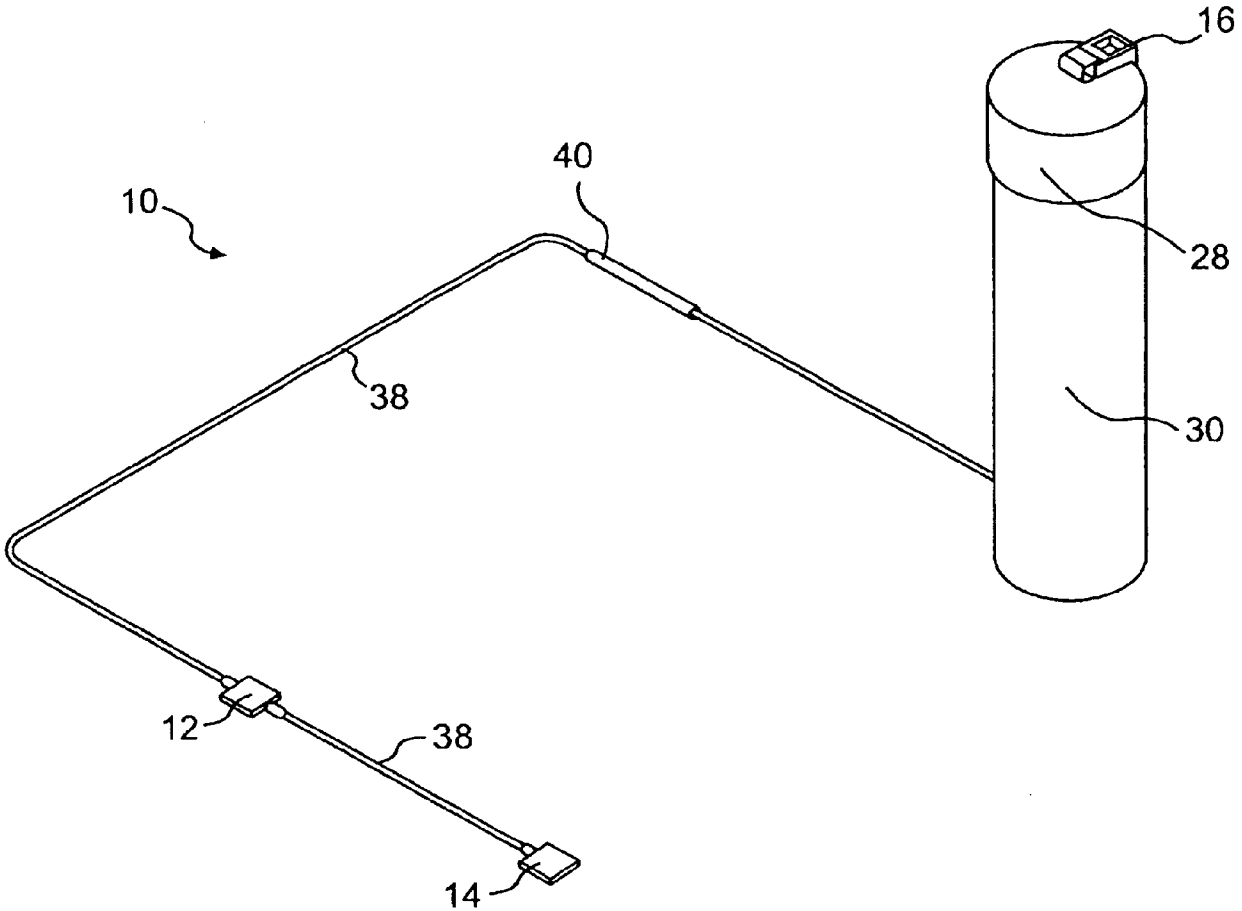
FIG. 1 is a perspective view of one embodiment of the present invention.
Figure 2:
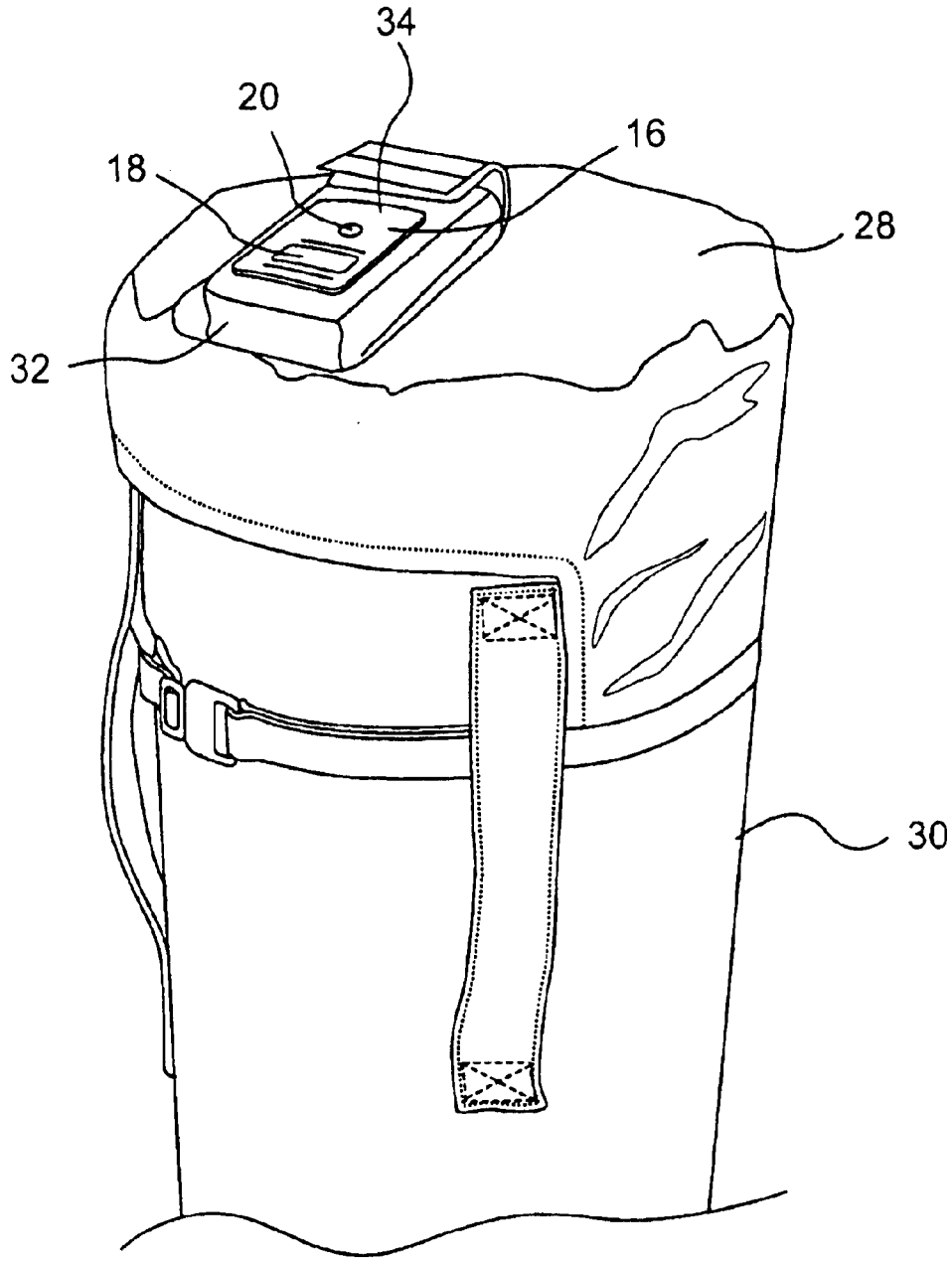
FIG. 2 is rear perspective view of a hood and controller of the present invention installed on a blocking dummy.
Figure 3:
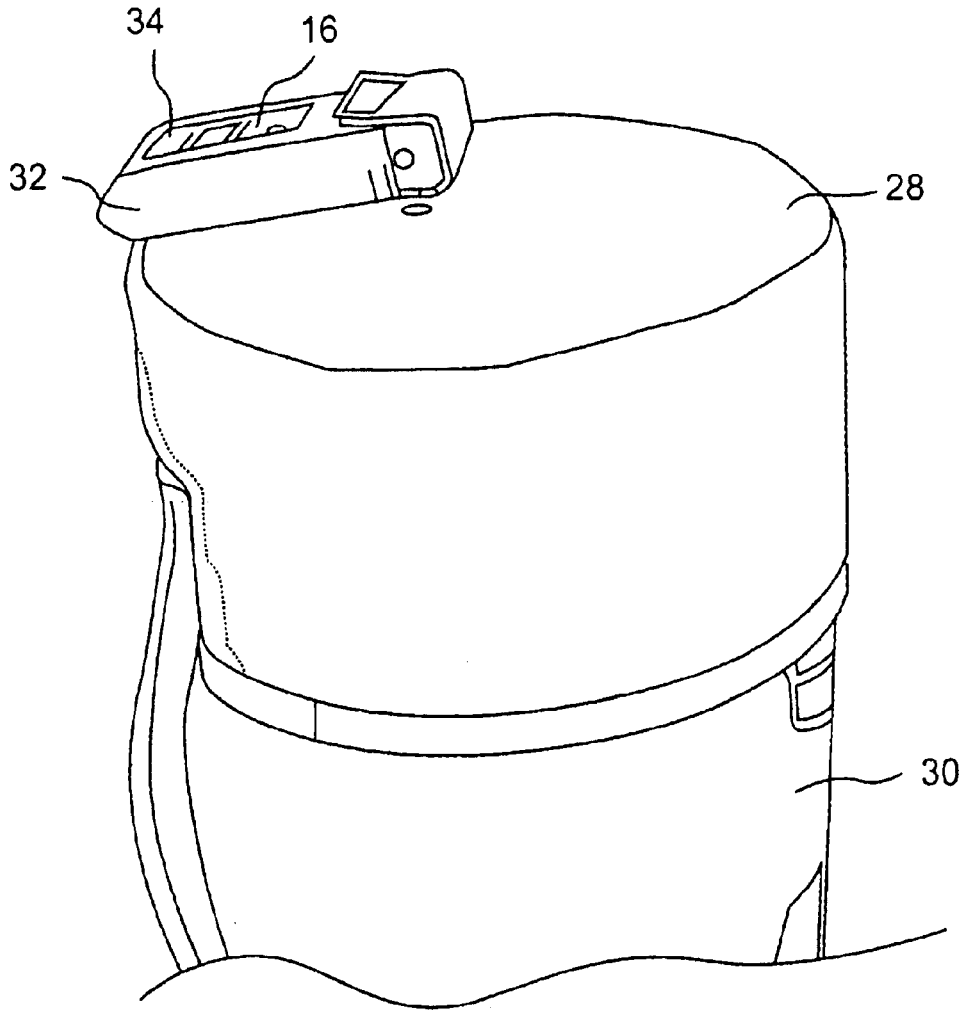
FIG. 3 is a side perspective view of the hood and controller shown in FIG. 2.
Figure 4:
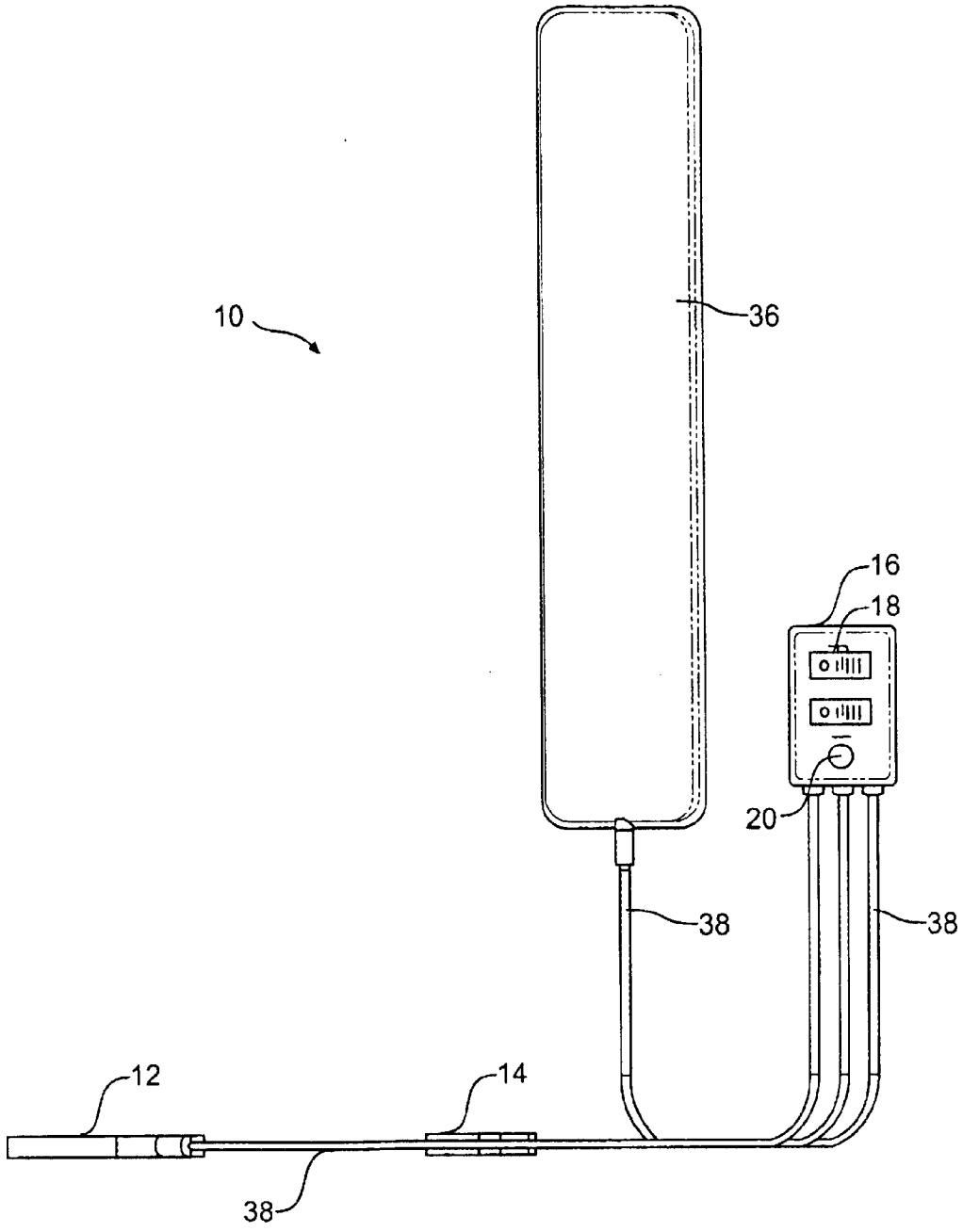
FIG. 4 is a front elevational view of an alternative embodiment of the present invention.

An athlete training device, generally indicated at 10, is shown in FIG. 1. It includes a first sensor pad 12 and a second sensor pad 14. Each sensing pad can sense when pressure is placed on the pad and when pressure is removed from the pad. In a preferred embodiment, each sensor pad is a sturdy, crush resistant, water resistant, self resetting, tamper proof switch that can signal when pressure has been removed from the sensor pad. In one embodiment, each sensor pad is approximately 4 inches square and ⅜ inch high and includes a simple electrical switch that closes a circuit when pressure is applied and opens the circuit when pressure is removed. The dimensions and characteristics of the sensor units can be changed as desired. In an alternative embodiment, the sensor pads can sense movement through use of other types of sensors, such as optical sensors or proximity sensors.

The athlete training device 10 also includes a control unit 16. See also, FIG. 5. The control unit 16 includes a CPU 22 for receiving the signals from the sensor pads 12 and 14 and calculating the measured times and also includes a display 18 for displaying the measured times. The display 18 is a two line, 8 character per line LCD display that can simultaneously display a snap reaction time one line and an explosiveness time on the second line. Other displays can also be used. A reset switch 20 is also included for resetting the CPU 22 for the next measurement and zeroing the readouts of the display 18. The signals from the sensor pads are first received in the control unit 16 by a filtering module 26 to filter the signals before being sent to the CPU 22. Other modules can also be included, such as a data memory module, measurement log module, or even a printer module, as desired, and can be incorporated as hardware and/or software modules. Undesired modules can be omitted.

As shown in FIG. 1, the control unit 16 can be mounted on a hood 28 constructed and arranged to fit over and attach to a standard blocking dummy 30. The hood 30 is preferably constructed of fabric and includes a pocket 32 for receiving the control unit 16 and securing the control unit 16 to the hood 28. The hood can be constructed of other materials, preferably flexible to prevent potential injury to the athlete. The pocket 32 includes a window 34 for allowing vision of the display 18.

The control unit 16 also includes an inertia switch 24 that can detect a shock to the control unit 16. Since in this embodiment, the control unit 16 is mounted to the blocking dummy 30 via the hood 28, the inertia switch 24 will detect when the athlete has hit the blocking dummy 30. In an alternative embodiment, as shown in FIG. 5, a pressure switch 36 remote from the control unit 16 and mountable to the blocking dummy 36 can be substituted for the inertia switch 24 to signal when the athlete has hit the blocking dummy 30.

Figure 5:
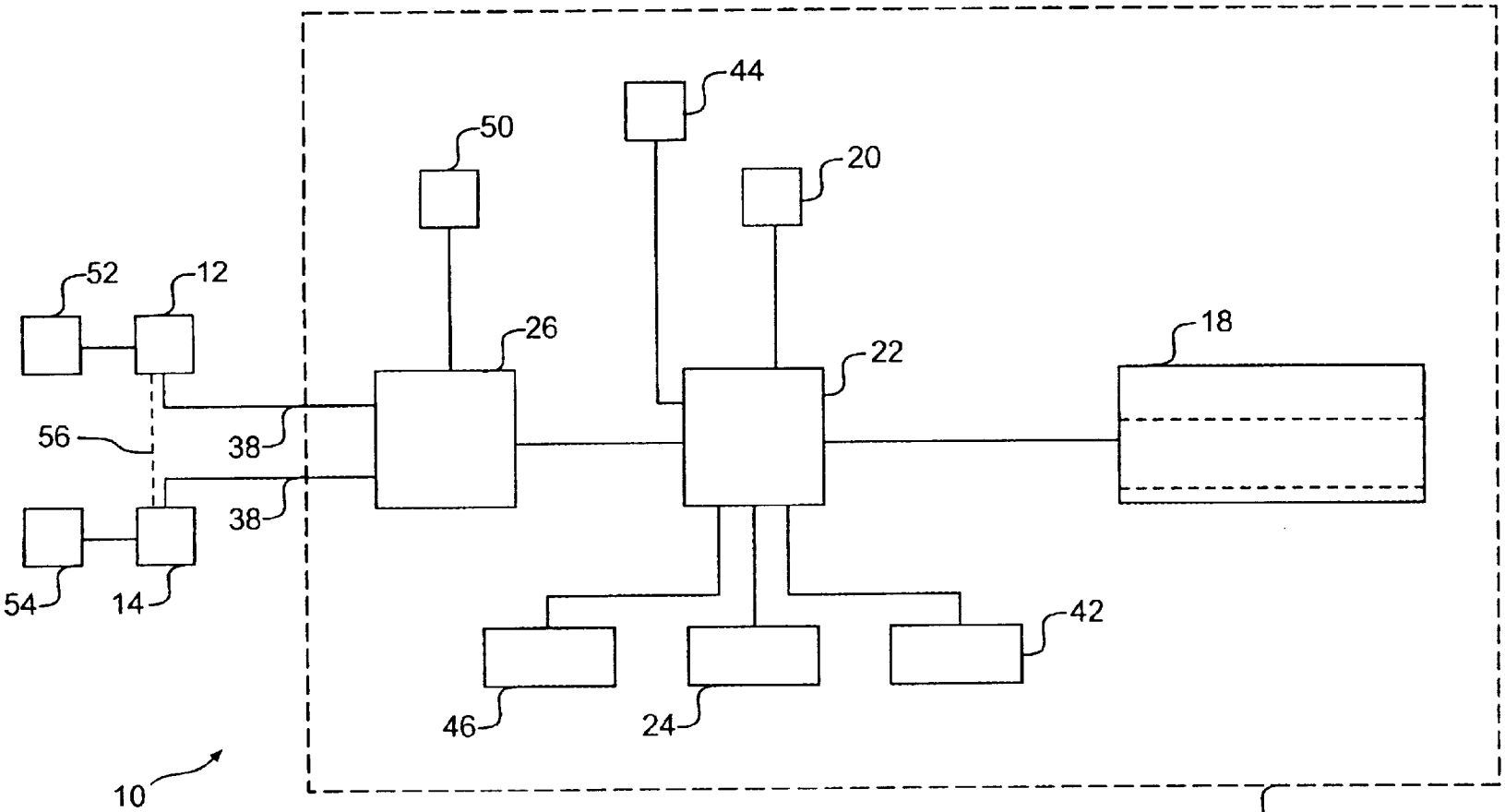
FIG. 5 is a schematic representation of the components of the present invention

As shown in FIGS. 1 and 5, the sensor pads 12 and 14 are connected to the control unit 16 by lines 38, which in these embodiments, are electrical lines. Optical lines can also be used with the correct components. The line 38 can include a coiled portion 40 for extra flexibility. In an alternative embodiment, the line 38 can be omitted and the athlete training device 10 can be wireless, using radio or optical signaling between the sensor pads and the control unit 16. In this case, wireless signal transmitters, such as units 52 and 54, would be incorporated in one or both of the sensor pads and a wireless signal receiver 50 would be incorporated in the control unit 16. In an embodiment where the two sensor pads were still linked by a line, such as line 56 shown in phantom, only one signal sending unit would be required. When using wireless signaling, the sensor pads would preferably incorporate batteries for powering the signal sending units. The control unit 16 is also includes a power source 46, preferably a battery power source.

The various components of the control unit 16 can be mounted in one case as shown in FIG. 1 or can be separated, as desired. As shown in FIG. 5, the control unit 16 can be positioned remotely from the blocking dummy 30.

It is desirable that the distance between the sensor pad 14 and the blocking dummy 30 be maintained to provide consistency between measurements. This can be accomplished by the length of the lines connecting the sensor pad 14 to the control unit. Alternatively, a separate measuring line can be provided on the sensor pad 14 or the hood 28 for maintaining the consistent distance. This distance is preferably about 3 feet from the sensor pad 14 to the blocking dummy 30 when measuring lineman. This distance can be set as desired. For instance, this distance might be preferably increased as being more reflective of actual playing conditions when measuring linebackers or defensive backs.

Operation of the training device 10 is as follows. The ball is first placed on the sensor pad 12 by the center and the athlete takes his stance with his hand on sensor pad 14. When the ball is snapped, the sensor pad 12 signals that the ball has been snapped and starts measuring the time elapsed until the athlete reacts and lifts his hand from sensor pad 14, thereby signaling the control unit 16 to end the first measurement. This measurement is then displayed on the display 18 as the snap reaction time. Concurrently, the lifting of the athlete's hand from the sensor pad 14 starts a second measurement that ends when the inertia switch 24 or pressure switch 36 indicates that the athlete has contacted the blocking dummy 30, thereby signaling the control unit 16 to end the second measurement. This second measurement is then displayed on the display 18 as the explosiveness time.

The training device 10 operates automatically and requires no input from the coach or observer, except to observe and record the measured data after the play is completed. The device 10 can then be reset simply by pushing the reset button 20 and a new measurement can take place.

The control unit 16 can also incorporate an accelerometer 42 (see FIG. 5) which can measure the force of the impact by the athlete and signal this to the CPU so that such measurement can be displayed on the display 18. In such an embodiment, the display would preferably include a third line dedicated to displaying this force of impact measurement. The control unit also preferably includes an on/off switch 44 to shut off the unit and conserve the batteries when the trainer 10 is not in use.

While primarily useful for measuring the skills of an offensive or defensive football lineman, the present invention can also be used to measure the reaction time and explosiveness of other football players or players in other sports. The control unit can also be mounted to a blocking sled or other object that the athlete will contact.

Various aspects of the different embodiments can be combined in different manners to create new embodiments.

What is claimed is:

1. An athlete training device, comprising;

a first sensor pad for signaling when a first object has been removed from the first sensor pad;

a second sensor pad for signaling when an athlete's hand has been removed from the second sensor pad;

a third sensor for signaling when the athlete has made contact with a second object spaced apart from the second sensor pad, a control device for receiving the signals from the first sensor pad, the second sensor pad and the third sensor, the control device determining a first elapsed time as the time between when the first object has been removed from the first sensor pad and the athlete's hand has been removed from the second sensor pad, the control device further determining a second elapsed time as the time between when the athlete's hand has been removed from the second sensor pad and the athlete has made contact with the second object; the control device outputting a signal for displaying the first elapsed time and the second elapsed time.

2. The athlete training device of claim 1, and further comprising a display for displaying the first elapsed time and the second elapsed time.

3. The athlete training device of claim 2, wherein each of the first sensor pad and the second sensor pad includes an electrical switch that moves between an open status and a closed status when the first object and the athlete's hand have been removed from the respective sensor pads.

4. The athlete training device of claim 3, wherein the third sensor is an inertial switch.

5. The athlete training device of claim 4, wherein at least one of the first and second sensor pads are connected to the control device by a line for signaling the control device.

6. The athlete training device of claim 5, and further comprising a fourth sensor for signaling to the control device an amount of force by which the athlete contacts the second object, the control device outputting a signal for displaying this contact force.

7. The athlete training device of claim 6, wherein the fourth sensor is an accelerometer.

8. The athlete training device of claim 7, and further comprising a mounting device for mounting the third sensor to the second object.

9. The athlete training device of claim 8, wherein the mounting device is a flexible hood constructed and arranged to mount to a blocking dummy.

10. The athlete training device of claim 9, wherein the third sensor, the control device and the display are mounted in a single case, the flexible hood including a windowed pocket for receiving the case.

11. The athlete training device of claim 10, and further including a reset button for resetting the control device for anew measurement and clearing the display.

12. The athlete training device of claim 4, and further comprising a wireless signal receiver connected to the control device and wherein at least one of the sensor pads comprises a wireless signal transmitter for transmitting its respective output signal to the wireless signal receiver for providing the signal to the control device.

13. The athlete training device of claim 3, wherein the third sensor is a pressure switch.

14. The athlete training device of claim 1, wherein the control device comprises a CPU.

15. The athlete training device of claim 1, and further comprising a fourth sensor for signaling to the control device an amount of force by which the athlete contacts the second object, the control device outputting a signal for displaying this contact force.

16. The athlete training device of claim 1, and further comprising a mounting device for mounting the third sensor to the second object, the mounting device being a flexible hood constructed and arranged to mount to a blocking dummy.

17. The athlete training device of claim 16, wherein the third sensor, the control device and the display are mounted in a single case, the flexible hood including a windowed pocket for receiving the case.

18. The athlete training device of claim 1, and further including a reset button for resetting the control device for anew measurement and clearing the display.

19. The athlete training device of claim 1, and further comprising a wireless signal receiver connected to the control device and wherein at least one of the sensor pads comprises a wireless signal transmitter for transmitting its respective output signal to the wireless signal receiver for providing the signal to the control device.

20. The athlete training device of claim 1, wherein the third sensor is an inertial switch.

* * * * *